US006808404B1

(12) United States Patent
Doyle et al.

(10) Patent No.: US 6,808,404 B1
(45) Date of Patent: Oct. 26, 2004

(54) JACK ASSEMBLY WITH CONTACT SWITCHING SYSTEM

(75) Inventors: Seamus Doyle, Ballycarney, Enniscorthy (IE); Francis Duggan, Shannon (IE); Maurice Shanahan, Westbury, Co. Clare (IE); Eugene Folan, Renmore, Galway (IE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/629,499

(22) Filed: Jul. 29, 2003

(51) Int. Cl.[7] ..... H01R 29/00
(52) U.S. Cl. ..... 439/188; 438/668; 200/51.1
(58) Field of Search ..... 439/188, 668, 439/669, 83; 200/51.09, 51.1

(56) References Cited

U.S. PATENT DOCUMENTS

| | | | | |
|---|---|---|---|---|
| 4,633,048 A | | 12/1986 | Komatsu | 200/51.1 |
| 4,978,310 A | | 12/1990 | Shichida | 439/188 |
| 5,277,628 A | | 1/1994 | Lin et al. | 439/668 |
| 5,338,215 A | | 8/1994 | Lee et al. | 439/188 |
| 5,893,767 A | | 4/1999 | Broschard, III | 439/188 |
| 5,919,052 A | | 7/1999 | Ho | 439/83 |
| 6,062,885 A | | 5/2000 | White | 439/188 |
| 6,155,854 A | | 12/2000 | Chen | 439/188 |
| 6,168,448 B1 | | 1/2001 | Chang | 439/188 |
| 6,220,898 B1 | | 4/2001 | Wu | 439/668 |
| 6,224,408 B1 | | 5/2001 | Wu | 439/188 |
| 6,312,274 B1 | | 11/2001 | Lin | 439/188 |
| 6,319,030 B1 | | 11/2001 | Wu | 439/188 |
| 6,478,629 B1 | | 11/2002 | Li et al. | 439/668 |
| 6,520,785 B2 | * | 2/2003 | Hida | 439/188 |
| 6,524,138 B1 | | 2/2003 | Li et al. | 439/669 |

* cited by examiner

*Primary Examiner*—Hien Vu
(74) *Attorney, Agent, or Firm*—Stephen Z. Weiss

(57) ABSTRACT

A jack assembly includes a contact switching system for receiving a coaxial plug. The assembly includes an insulative housing having a plug-receiving chamber. A fixed terminal is mounted on the housing and has a fixed switch contact portion located outside the chamber. A moveable terminal is mounted on the housing and includes a spring arm located inside the chamber in the path of insertion of the coaxial plug. A movable switch contact portion is connected to the spring arm for movement therewith into and out of engagement with the fixed switch contact portion. The movable switch contact portion is located outside the chamber. Therefore, engagement of the coaxial plug with the spring arm inside the chamber is effective to cause relative movement of the switch contact portions outside the chamber.

8 Claims, 3 Drawing Sheets

JACK ASSEMBLY WITH CONTACT SWITCHING SYSTEM

FIELD OF THE INVENTION

This invention generally relates to the art of electrical connectors and, particularly, to a jack assembly which includes a contact switching system for receiving a coaxial plug.

BACKGROUND OF THE INVENTION

One type of jack assembly is designed for receiving a pin-type coaxial plug. The plug is inserted into an opening at the outside of the jack and into a cavity or plug-receiving chamber inside a dielectric housing of the jack. The housing mounts a plurality of terminals which are exposed within the chamber in the path of movement of the coaxial plug, whereby the plug engages the contacts to effect various electrical functions One pair of fixed and movable contacts may effect a switching function when the coaxial plug is inserted into the plug-receiving chamber of the jack housing.

One of the problems with switching contacts in jacks of this type is to maintain or ensure good electrical engagement between the movable and fixed contacts. The engaging surfaces of the contacts often become contaminated which deteriorates the effectiveness of the contact coupling therebetween. This contamination is particularly prevalent when the contacts are located within the plug-receiving chamber which is exposed for receiving the coaxial plug. Attempts have been made to provide a wiping action between the engaging surfaces of the movable contacts and the fixed contacts to counteract such contamination. However, most such jack assemblies are extremely small due to the ever-increasing miniaturization of such connector assemblies. The compact envelope afforded by such miniature constructions results in extremely small plug-receiving chambers and leave little room for providing adequate wiping actions within the chambers. The present invention is directed to solving these problems in an improved jack assembly of the character described.

SUMMARY OF THE INVENTION

An object, therefore, of the invention is to provide a new and improved jack assembly which includes a contact switching system for receiving a coaxial plug.

In the exemplary embodiment of the invention, the jack assembly includes an insulative housing having a plug-receiving chamber with an opening for receiving the coaxial plug in a plug-insertion direction. A fixed terminal is mounted on the housing and has a fixed switch contact portion located outside the plug-receiving chamber. A movable terminal is mounted on the housing and includes a spring arm at least partially located inside the plug-receiving chamber in the path of insertion of the coaxial plug, and a movable switch contact portion is connected to the spring arm for movement therewith into and out of engagement with the fixed contact portion of the fixed terminal. The movable switch contact portion is located outside the plug-receiving chamber.

With the above structure, engagement of the coaxial plug with the spring arm of the movable terminal inside the plug-receiving chamber is effective to cause the movable switch contact portion of the movable terminal to move relative to the fixed switch contact portion of the fixed terminal outside the plug-receiving chamber. Therefore, the size and/or shape of the contact portions of the terminals outside the chamber are not restricted by the size and/or shape of the chamber, itself.

According to one aspect of the invention, the movable switch contact portion of the movable terminal and the fixed switch contact portion of the fixed terminal comprise generally planar plates having interengaging wiping surfaces of substantial size which wipe over each other when the contact portions move relative to each other.

According to another aspect of the invention, the movable terminal is generally U-shaped to define a pair of legs. One leg is fixed to the housing. The other leg forms the spring arm of the movable terminal, with the spring arm at least partially located inside the plug-receiving chamber in the path of insertion of the coaxial plug. The movable switch contact portion extends from the other leg toward the fixed switch contact portion outside the chamber.

According to a further aspect of the invention, the spring arm of the movable terminal is pivotally movable upon engagement by the coaxial plug, about a pivot axis which extends generally perpendicular to the plug-insertion direction of the coaxial plug. The movable switch contact portion of the movable terminal slides over the fixed switch contact portion of the fixed terminal in a direction generally parallel to the plug-insertion direction of the coaxial plug.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
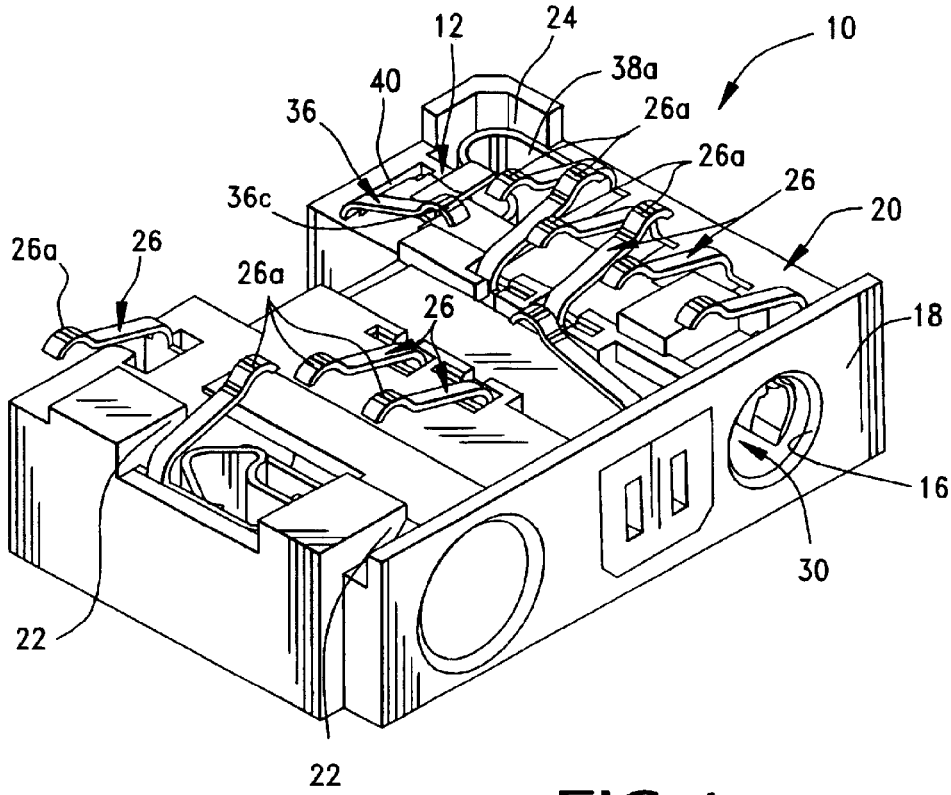
FIG. 1 is a top perspective view of an inner dielectric or insulative housing of a jack assembly, with various terminals mounted on the housing.
Figure 2:
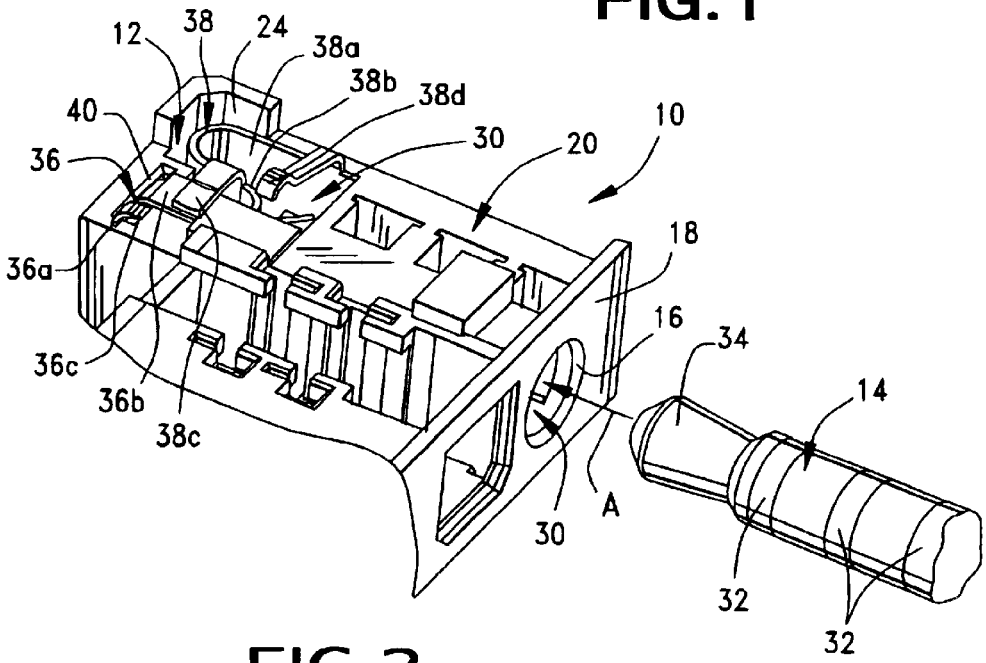
FIG. 2 is a fragmented perspective view of the housing of FIG. 1, with only the switching terminals of the invention shown on the housing, and in conjunction with a coaxial plug about to be inserted into the housing.

Referring to the drawings in greater detail, and first to FIG. 1, the invention is embodied in a jack assembly, generally designated 10, which includes a contact switching system, generally designated 12, for receiving a coaxial plug, generally designated 14 (FIG. 2). The coaxial plug is inserted into an opening 16 in a front panel 18 of the jack assembly in a plug-insertion direction as indicated by arrow "A" in FIG. 2.

The jack assembly includes an insulative or dielectric housing, generally designated 20, which may be molded of plastic material or the like. Front panel 18 may be molded integrally with the housing. The upper side of the housing as viewed in FIGS. 1 and 2 is adapted for mounting a printed circuit board. For instance, one edge of the board may be inserted under a pair of mounting hooks 22, while press-fitting a corner of the circuit board within an angled upright flange 24. A plurality of signal terminals, generally designated 26, are mounted in housing 20 and include contact portions 26*a* for engaging appropriate circuit traces on the underside of the printed circuit board.

Figure 3:
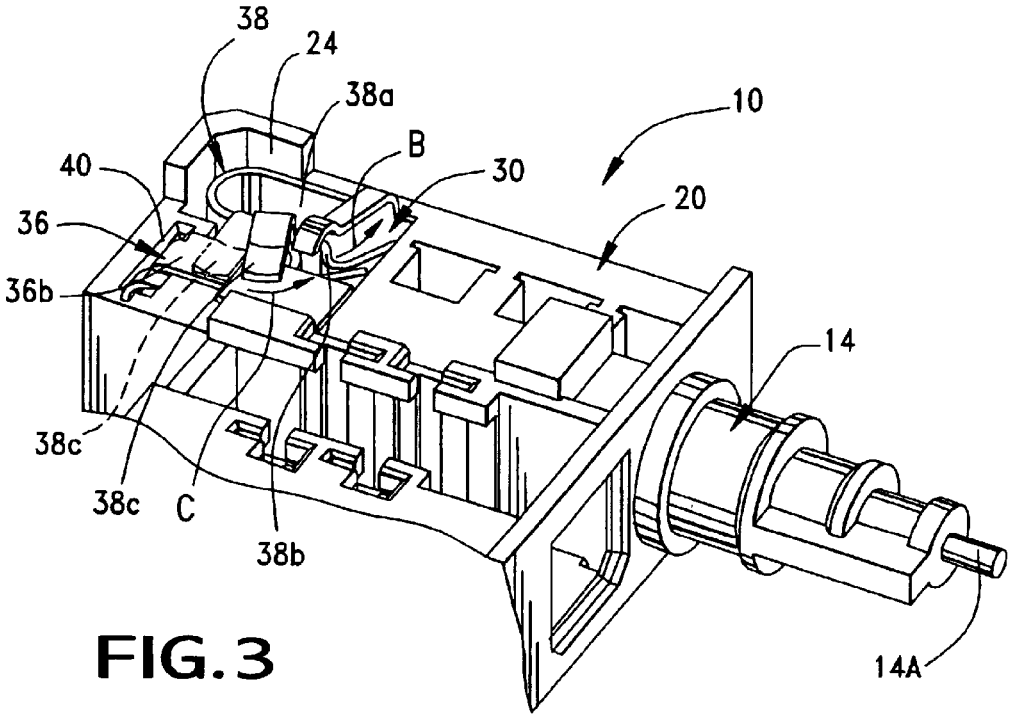
FIG. 3 is a view similar to that of FIG. 2, with the coaxial plug fully inserted into the housing and showing the movable switch portion of the movable terminal moved to an open position from a closed position shown in phantom.

Before describing the switching system of the invention, it should be understood that opening 16 defines a mouth of a plug-receiving chamber, generally designated 30, which extends interiorly of the housing all the way from opening 16 to the switch terminals (described hereinafter) of switching system 12 according to the invention. As is known in the art, coaxial plug 14 (FIG. 2) includes a plurality of peripheral, axially insulated terminals 32 spaced along the length of the plug for engaging terminals 26 which are spaced along the interior plug-receiving chamber 30 of the housing. The coaxial plug terminates in a rearwardly tapered distal end 34. The coaxial plug terminates a coaxial cable 14A (FIG. 3).

Referring particularly to FIG. 2, switching system 12 of the invention generally includes a fixed terminal, generally designated 36, and a movable terminal, generally designated 38. As will be seen in greater detail hereinafter, fixed terminal 36 includes a body portion 36*a* for mounting the fixed terminal, as by a press-fit, into a mounting aperture 40 in the housing. The fixed terminal has a fixed switch contact portion 36*b* in the form of a fairly sizable, generally planar plate having a top wiping surface of a substantial size. The terminal also includes a tail portion 36*c* which is cut-off in FIG. 2 but shown clearly in FIG. 1. The tail portion is provided for engaging a circuit trace on the underside of the printed circuit board (not shown).

Movable terminal 38 also includes a body portion 38*a* which is fixed to the housing. The terminal is generally U-shaped, with body portion 38*a* forming one leg of the U-shape and a spring arm 38*b* forming the other leg of the U-shape. Spring arm 38*b* is located within plug-receiving chamber 30 as seen in FIG. 2 in the path of movement of coaxial plug 14. The spring arm is free to move within chamber 30 in a direction generally perpendicular to the insertion direction of the plug. Movable terminal 38 includes a movable switch contact portion 38*c* which is connected to spring arm 38*b* for movement therewith into and out of engagement with fixed switch contact portion 36*b* of fixed terminal 36. Like the fixed switch contact portion of the fixed terminal, movable switch contact portion 38*c* of movable terminal 38 is provided by a fairly sizable, generally planar plate having a wiping surface on the underside thereof The wiping surface provided by movable switch contact portion 38*c* is of a substantial size and wipes over the wiping surface provided by fixed switch contact portion 36*b* of the fixed terminal. Finally, movable terminal 38 has a tail portion 38*d* for engaging a circuit trace on the underside of the printed circuit board.

FIG. 2 shows movable switch contact portion 38*c* of movable terminal 38 in engagement with fixed switch contact portion 36*b* of fixed terminal 36 when coaxial plug 14 is removed from the jack assembly. FIG. 3 shows coaxial plug 14 fully inserted into chamber 30 interiorly of housing 20. When fully inserted, distal end 34 of the coaxial plug engages spring arm 38*b* of movable terminal 38 and pivots the arm in the direction of arrow "B". This moves switch contact portion 38*c* of the movable terminal with the spring arm in the direction of arrow "C" away from fixed switch contact portion 36*b* of fixed terminal 36 to, in essence, "open" the switch system provided by these terminals. Movable switch contact portion 38*c* is shown in phantom in FIG. 3 in its closed position engaging fixed switch contact portion 36*b,* and in full lines in its open position out of engagement with the fixed switch contact portion.

Figure 4A:
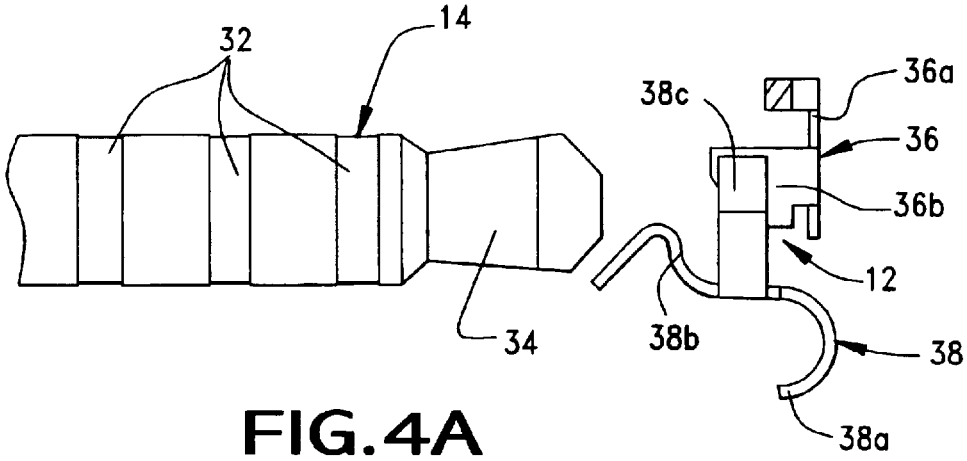
FIGS. 4A–4C show the coaxial plug and the switch terminals isolated from the housing and sequentially illustrating the engagement of the plug with the movable terminal and the movement of the movable terminal relative to the fixed terminal.
Figure 4B:
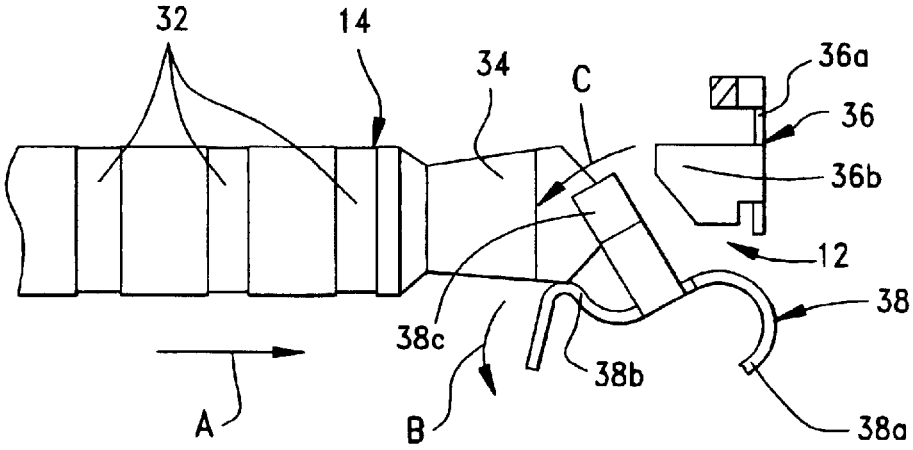
Figure 4C:
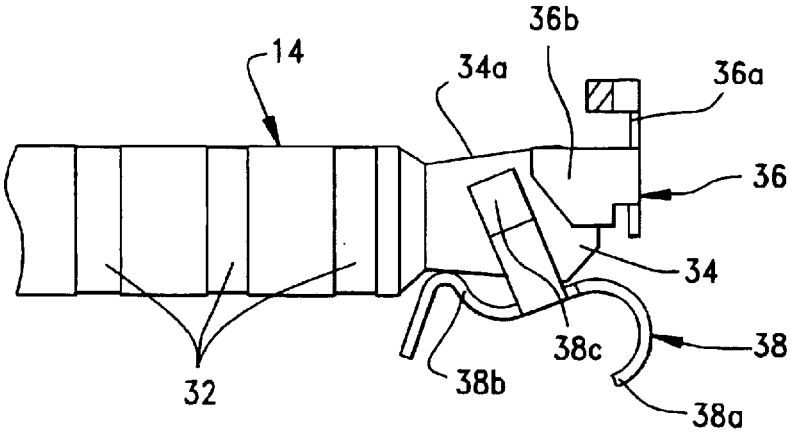

FIGS. 4A–4C show coaxial plug 14 and switching system 12 isolated from the jack housing to clearly show the movement of the movable terminal relative to the fixed terminal as the coaxial plug is inserted into chamber 30. FIG. 4A corresponds to the positions of the components shown in FIG. 2. FIG. 4B shows the relative positions of the plug and switch terminals corresponding to FIG. 3. FIG. 4C shows the coaxial plug in its final or fully seated position within the jack assembly.

More particularly, FIG. 4A shows distal end 34 of coaxial plug 14 partially inserted into the interior chamber of the jack assembly but not yet engaging spring arm 38*b* of the U-shaped movable terminal 38. In this condition of the jack assembly, movable switch contact portion 38*c* of the movable terminal is in engagement with fixed switch contact portion 36*b* of fixed terminal 36 to "close" the switch.

FIG. 4B shows coaxial plug 14 inserted further in the direction of arrow "A" until distal end 34 of the plug has engaged spring arm 38*b* of movable terminal 38. This engagement causes the spring arm to pivot about a pivot axis provided by fixed body portion 38*a* of the movable terminal, generally in the direction of arrow "B". In essence, the coaxial plug causes the spring arm to pivotally move generally perpendicular to the insertion direction "A" of the plug. Movable switch contact portion 38*c* of the movable terminal moves in the direction of arrow "C" away from fixed switch contact portion 38*b* of fixed terminal 38. This separation of the switch contact portions of the two terminals effectively "opens" switching system 12 of the jack assembly.

FIG. 4C shows coaxial plug 14 fully inserted into its fully seated position within the jack assembly, with spring arm 38*b* of movable terminal 38 engaging an inwardly tapered surface 34*a* of distal end 34 of the coaxial plug. Movable switch contact portion 38*c* of the movable terminal still is separated from fixed contact portion 36*b* of fixed terminal 36.

Figure 5:
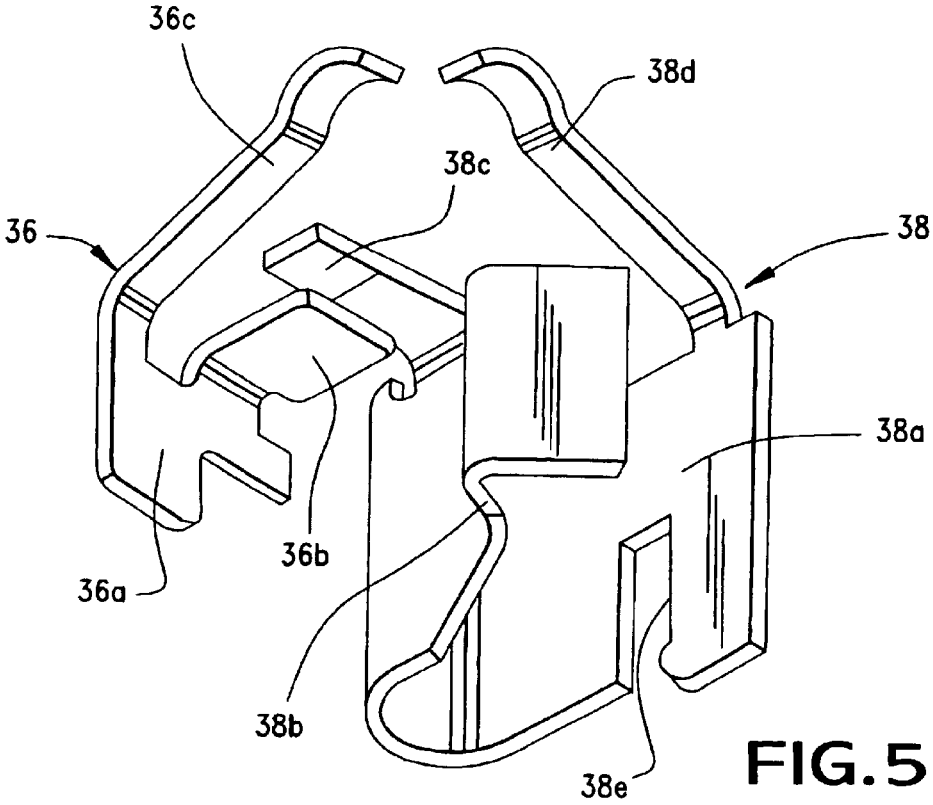
FIG. 5 is a bottom perspective view of the movable and fixed terminals.

FIG. 5 shows fixed terminal 36 and movable terminal 38 isolated from the jack assembly. The shape of body portion 36*a* of fixed terminal 36 is clearly shown. The body portion is press-fit into mounting aperture 40 of the housing as shown in FIGS. 1–3 and as described above. Similarly, body portion 38*a* of movable terminal 38 is fixed to housing 20 while spring arm 38*b* is free to move within the plug-receiving chamber 30 of the housing. Body portion 38*a* has a slot 38*e* for press-fitting onto a locking boss (not visible in the drawings) integral with housing 20 and inside chamber 30. Therefore, body portion 38*a* is fixed to the housing and defines the pivot axis of movement for spring arm 38*b* and movable switch contact portion 38*c*.

From the foregoing, it can be understood that the switching system of the invention provides an arrangement whereby the interengagement of movable terminal 38 and coaxial plug 14 occurs inside or interiorly of plug-receiving chamber 30, while the interengagement of the movable terminal with fixed terminal 36 occurs outside the chamber. In other words, coaxial plug 14 engages spring arm 38*b* of the movable terminal inside the chamber. Movable switch contact portion 38*c* of the movable terminal engages fixed contact portion 38*b* of fixed terminal 36 outside the chamber. With this unique system, the sizes and/or shapes of the interengaging contact portions of the terminals are not in any way dependent upon or restricted by the size and/or shape of chamber 30. As stated and described above, movable switch contact portion 38*c* and fixed switch contact portion 38*b* can be of substantial sizes providing large wiping surfaces to remove contamination therefrom. These large wiping surfaces are not restricted by the size of the chamber which receives the coaxial plug. In addition, by locating the interengaging switch contact portions of the terminals at a point removed from the chamber, the switch contact portions are isolated from the contaminants which enter the chamber as a result of repeated insertions and removals of the coaxial plug.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A jack assembly which includes a contact switching system for receiving a coaxial plug, comprising:

an insulative housing having a plug-receiving chamber with an opening for receiving the coaxial plug in a plug-insertion direction;

a fixed terminal mounted on the housing and having a fixed switch contact portion located outside said plug-receiving chamber; and a movable terminal mounted in the housing and including a spring arm at least partially located inside the plug-receiving chamber in the path of insertion of the coaxial plug and a movable switch contact portion connected to the spring arm and extended outwardly from the housing for movement therewith into and out of engagement with the fixed switch contact portion of the fixed terminal, the movable switch contact portion being located outside the plug-receiving chamber, whereby engagement of the coaxial plug with the spring arm inside the plug-receiving chamber is effective to cause the movable switch contact portion of the movable terminal to move relative to the fixed switch contact portion of the fixed terminal outside the plug-receiving chamber, wherein the movable switch contact portion of the movable terminal and the fixed switch contact portion of the fixed terminal comprise generally planar plates having interengaging wiping surfaces of substantial size which wipe over each other when the contact portions move relative to each other.

2. The jack assembly of claim 1 wherein said spring arm of the movable terminal is pivotally movable upon engagement by the coaxial plug, about a pivot axis which extends generally perpendicular to the plug-insertion direction of the coaxial plug.

3. The jack assembly of claim 2 wherein the movable switch contact portion of the movable terminal slides over the fixed switch contact portion of the fixed terminal in a direction generally parallel to the plug-insertion direction of the coaxial plug.

4. The jack assembly of claim 1 wherein the movable switch contact portion of the movable terminal and the fixed switch contact portion of the fixed terminal comprise generally planar plates having interengaging wiping surfaces of substantial size which wipe over each other when the contact portions move relative to each other.

5. A jack assembly which includes a contact switching system for receiving a coaxial plug, comprising:

an insulative housing having a plug-receiving chamber with an opening for receiving the coaxial plug in a plug-insertion direction;

a fixed terminal mounted on the housing and having a fixed switch contact portion located outside said plug-receiving chamber;

a movable terminal mounted in the housing and including a spring arm at least partially located inside the plug-receiving chamber in the path of insertion of the coaxial plug and a movable switch contact portion connected to the spring arm and extended outwardly from the housing for movement therewith into and out of engagement with the fixed switch contact portion of the fixed terminal, the movable switch contact portion being located outside the plug-receiving chamber, the spring arm being pivotally movable upon engagement by the coaxial plug about a pivot axis which extends generally perpendicular to the plug-insertion direction of the coaxial plug, the movable switch contact portion being slidable over the fixed switch contact portion of the fixed terminal in a direction generally parallel to the plug-insertion direction of the coaxial plug; and the movable switch contact portion of the movable terminal and the fixed switch contact portion of the fixed terminal comprising generally planar plates having interengaging wiping surfaces of substantial size which wipe over each other when the contact portions move relative to each other;

whereby engagement of the coaxial plug with the spring arm inside the plug-receiving chamber is effective to cause the movable switch contact portion of the movable terminal to move relative to the fixed switch contact portion of the fixed terminal outside the plug-receiving chamber.

6. The jack assembly of claim 5 wherein said movable terminal is generally U-shaped defining a pair of legs, one leg being fixed to the housing, the other leg forming said spring arm at least partially located inside the plug-receiving chamber in the path of insertion of the coaxial plug, and said movable switch contact portion extending from the other leg toward the fixed switch contact portion outside the chamber.

7. A jack assembly which includes a contact switching system for receiving a coaxial plug, comprising:

an insulative housing having a plug-receiving chamber with an opening for receiving the coaxial plug in a plug-insertion direction;

a fixed terminal mounted in the housing and having a fixed switch contact portion;

a movable terminal mounted on the housing and including a spring arm in the path of insertion of the coaxial plug and a movable switch contact portion connected to the spring arm and extended outwardly from the housing for movement therewith into and out of engagement with the fixed switch contact portion of the fixed terminal, the spring arm being pivotally movable upon engagement by the coaxial plug about a pivot axis which extends generally perpendicular to the plug-insertion direction of the coaxial plug, and the movable switch contact portion being slidable over the fixed switch contact portion of the fixed terminal in a direction generally parallel to the plug-insertion direction of the coaxial plug, wherein the movable switch contact portion of the movable terminal and the fixed switch contact portion of the fixed terminal comprise generally planar plates having interengaging wiping surfaces of substantial size which wipe over each other when the contact portions move relative to each other.

8. The jack assembly of claim 7 wherein said movable terminal is generally U-shaped defining a pair of legs, one leg being fixed to the housing, the other leg forming said spring arm at least partially located inside the plug-receiving chamber in the path of insertion of the coaxial plug, and said movable switch contact portion extending from the other leg toward the fixed switch contact portion outside the chamber.

* * * * *